US011313015B2

(12) United States Patent
Wang et al.

(10) Patent No.: US 11,313,015 B2
(45) Date of Patent: Apr. 26, 2022

(54) HIGH STRENGTH AND HIGH WEAR-RESISTANT CAST ALUMINUM ALLOY

(71) Applicants: GM GLOBAL TECHNOLOGY OPERATIONS LLC, Detroit, MI (US); SHANGHAI JIAO TONG UNIVERSITY, Shanghai (CN)

(72) Inventors: Qigui Wang, Rochester Hills, MI (US); Wenying Yang, Rochester Hills, MI (US); Bing Ye, Minhang (CN)

(73) Assignee: GM Global Technology Operations LLC, Detroit, MI (US)

( * ) Notice: Subject to any disclaimer, the term of this patent is extended or adjusted under 35 U.S.C. 154(b) by 629 days.

(21) Appl. No.: 15/938,186

(22) Filed: Mar. 28, 2018

(65) Prior Publication Data

US 2019/0300988 A1 Oct. 3, 2019

(51) Int. Cl.
*C22C 21/02* (2006.01)
*C22C 21/04* (2006.01)

(52) U.S. Cl.
CPC ..... *C22C 21/02* (2013.01); *C22C 21/04* (2013.01)

(58) Field of Classification Search
None
See application file for complete search history.

(56) References Cited

U.S. PATENT DOCUMENTS 5,484,492 A * 1/1996 Rogers ..... C22C 21/04 148/437
6,733,726 B2 5/2004 O'Connor
6,923,935 B1 8/2005 Donahue et al.
7,666,353 B2 2/2010 Donahue et al.
8,636,855 B2 1/2014 Wang et al.
8,758,529 B2 6/2014 Wang et al.
9,068,252 B2 7/2015 Wang
9,677,158 B2 6/2017 Wang et al.
(Continued)

FOREIGN PATENT DOCUMENTS

EP 3176275 A1 * 6/2017 ..... C22F 1/043

OTHER PUBLICATIONS

Sigworth, G.K. "Modification of Aluminum-Silicon Alloys". ASM Casting: vol. 15, p. 240-254. (Year: 2008).*
(Continued)

*Primary Examiner* — George Wyszomierski
*Assistant Examiner* — Janell C Morillo
(74) *Attorney, Agent, or Firm* — Bonnie Shaw

(57) ABSTRACT

Aluminum alloys having improved properties are provided. The alloy includes about 13 to about 17 weight percent silicon, about 0.3 to about 0.6 weight percent magnesium, and at least 75 weight percent aluminum. The alloy may include copper up to about 2.0 weight percent; iron up to about 0.8 weight percent; manganese up to about 1.0 weight percent; nickel up to about 1.0 weight percent; zinc up to about 0.8 weight percent; titanium up to about 0.5 weight percent; zirconium up to about 0.5 weight percent; vanadium up to about 0.5 weight percent; and other trace elements up to about 0.1 weight percent. In addition, the alloy may contain about 50 to about 1000 ppm of strontium and about 10 about 100 ppm phosphorus. Also disclosed is a die cast article, such as transmission clutch housing.

4 Claims, 4 Drawing Sheets

(56) References Cited

U.S. PATENT DOCUMENTS

| | | | | |
|---|---|---|---|---|
| 2014/0017115 | A1* | 1/2014 | Wang | C22C 21/04 420/535 |
| 2014/0319956 | A1 | 10/2014 | Wang et al. | |
| 2016/0250683 | A1* | 9/2016 | Wang | G01N 33/20 420/532 |
| 2017/0107599 | A1 | 4/2017 | Wang et al. | |
| 2018/0010214 | A1 | 1/2018 | Wang et al. | |

OTHER PUBLICATIONS

Aluminium Alloy Temper Designations, Aalco Metals Ltd., www.aalco.co.uk, Jan. 12, 2016, pp. 1-3.
Aluminum Alloys 101, Mercalloy, https://www.mercalloy.com/aluminum-alloys-101, May 20, 2016.
Aluminum A380 Die Casting, Trident Components LLC, http://www.tridentcomponents.com/A380-die-casting/, 2016.
Aluminum Alloy 383 Die Casting, Trident Components LLC, http://www.tridentcomponents.com/A383-die-casting/, 2016.
ADC 10 Die Casting, Trident Components LLC, http://www.tridentcomponents.com/adc-10-die-casting/, 2016.
Aluminum Alloy 360 Die Casting, Trident Components LLC, http://www.tridentcomponents.com/A360-die-casting/, 2016.
U.S. Appl. No. 14/632,308, filed Feb. 26, 2015, Titled: Secondary Cast Aluminum Alloy for Structural Applications, Applicant: GM Global Technology Operations LLC.
U.S. Appl. No. 14/886,263, filed Oct. 19, 2015, Titled: New High Pressure Die Casting Aluminum Alloy for High Temperature and Corrosive Applications, Applicant: GM Global Technology Operations LLC.
ASM Specialty Handbook Aluminum and Aluminum Alloys; ASM International, pp. 1-3, 1993.
U.S. Appl. No. 15/844,860, filed Dec. 18, 2017, Titled: Cast Aluminum Alloy for Transmission Cluctch, Applicant GM Global Technology Operations LLC.

* cited by examiner

HIGH STRENGTH AND HIGH WEAR-RESISTANT CAST ALUMINUM ALLOY

FIELD

The present disclosure relates generally to aluminum alloys, and more particularly, to high strength and high wear-resistant cast aluminum alloys that have improved casting quality and reduced porosity, as well as cast articles made therefrom, such as transmission clutch housings.

INTRODUCTION

Typical die casting aluminum alloys are Al—Si based alloys that contain about 3-4% Cu. It is generally accepted that copper (Cu) has the single greatest impact of all alloying elements on the strength and hardness of aluminum casting alloys, both heat-treated and not heat-treated, and at both ambient and elevated service temperatures. Copper also improves the machinability of alloys by increasing matrix hardness, making it easier to generate small cutting chips and fine machined finishes. Furthermore, copper is difficult to remove from aluminum in the mining process.

A process known as high pressure die casting (HPDC) is widely used for mass production of metal components because of low cost, close dimensional tolerances (near-net-shape) and smooth surface finishes. One disadvantage of the conventional HPDC process, however, is that the parts are not amenable to solution treatment (T4) at a high temperatures, such as 500° C., which significantly reduces the potential of precipitation hardening through a full T6 and/or T7 heat treatment. This is because of the presence of a high quantity of porosity and voids in the finished HPDC components due to shrinkage during solidification, and in particular, the entrapped gases during mold filling, such as air, hydrogen or vapors formed from the decomposition of die wall lubricants. It is almost impossible to find a conventional HPDC component without large gas bubbles. The internal pores containing gases or gas forming compounds in the high pressure die castings expand during conventional solution treatment at elevated temperatures, resulting in the formation of surface blisters on the castings. The presence of these blisters affects not only the appearance of the castings, but also dimensional stability, and in particular, mechanical properties of the HPDC components.

An aluminum 390 alloy was developed for strength and wear resistance, which includes copper, magnesium, and silicon. Magnesium, like copper, had been added to alloys to improve strengthening for the 390 alloys subjected to a heat treatment process. Silicon directly improved wear resistance. However, the copper in the 390 alloys increases shrinkage porosity and high silicon makes the 390 aluminum alloy brittle. Because of the nature of brittleness of the 390 aluminum alloys, the actual properties of the components made with 390 aluminum alloys are much lower than shown in handbook data.

390 aluminum alloys are typically used to make transmission clutch housings because of its strength and wear resistant properties. However, due to the low ductility of 390 aluminum alloys, transmission clutch housings may crack during manufacturing processes and are thus subjected to eddy current check for every part made. Even if the parts pass the eddy current check, they may still fail in the field, and thus warranty cost is high.

Accordingly, there is a need to develop high strength and high wear-resistant cast aluminum alloys for use in die cast articles.

SUMMARY

This disclosure provides high strength cast aluminum alloys that have reduced brittleness and reduced shrinkage tendency typically seen in a 390 aluminum alloy, as well as cast articles made therefrom, such as transmission clutch housings. The new alloy has high strength and high wear resistance, with better castability and low tendency of porosity. The new alloy also has desirable ductility and high fracture toughness. The new alloy can be made with both permanent mold and high pressure die casting processes.

In one example, which may be combined with or separate from the other examples and features provided herein, an aluminum alloy suitable for die casting is provided. The aluminum alloy may contain: about 13.0 to about 17.0 weight percent silicon, about 0.3 to about 0.6 weight percent magnesium; copper in an amount not exceeding 2.0 weight percent; and at least 75 weight percent aluminum.

In another example, which may be combined with or separate from the other examples and features provided herein, an aluminum alloy suitable for die casting is provided. The aluminum alloy may contain: about 13.0 to about 15.9 weight percent silicon, about 0.3 to about 0.6 weight percent magnesium; and at least 75 weight percent aluminum.

Additional features may be provided, including but not limited to the following: the aluminum alloy further comprising copper in an amount not exceeding 2.0 weight percent; the aluminum alloy further comprising iron in an amount not exceeding 0.8 weight percent; the aluminum alloy further comprising manganese in an amount not exceeding 1.0 weight percent; wherein the iron and manganese are provided in amounts that are no more than 25% different from each other; the aluminum alloy further comprising nickel in an amount not exceeding 1.0 weight percent; the aluminum alloy further comprising titanium in an amount not exceeding 0.5 weight percent; the aluminum alloy further comprising zirconium in an amount not exceeding 0.5 weight percent; the aluminum alloy further comprising vanadium in an amount not exceeding 0.5 weight percent; and the aluminum alloy further comprising about 50 to about 1000 ppm strontium; the aluminum alloy of further comprising about 10 to about 100 ppm phosphorus; the aluminum alloy containing at least 0.1 weight percent nickel; the aluminum alloy containing at least 0.1 weight percent titanium; the aluminum alloy containing at least 0.1 weight percent zirconium; the aluminum alloy containing at least 0.1 weight percent vanadium; the aluminum alloy comprising zinc in an amount not exceeding 0.5 weight percent; the aluminum alloy containing about 15 weight percent silicon; the aluminum alloy containing about 1.5 weight percent copper; the aluminum alloy containing about 0.4 weight percent magnesium; the aluminum alloy comprising about 0.1 to about 0.6 weight percent nickel; the aluminum alloy comprising about 0.1 to about 0.3 weight percent titanium; the aluminum alloy comprising about 0.1 to about 0.3 weight percent zirconium; the aluminum alloy comprising about 0.15 to about 0.3 weight percent vanadium; the aluminum alloy comprising about 50 to about 100 ppm strontium; the aluminum alloy comprising about 10 to about 50 ppm phosphorus; and the wherein the magnesium is provided in an amount not exceeding 0.5 weight percent.

In another example, which may be combined with or separate from the other examples and features provided herein, the aluminum alloy has or consists essentially of: 13 to 17 weight percent silicon; 0.3 to 0.6 weight percent magnesium; 0 to 2.0 weight percent copper; 0 to 0.8 weight percent iron; 0 to 1.0 weight percent manganese; 0 to 1.0 weight percent nickel; 0 to 0.8 weight percent zinc; 0 to 0.5 weight percent titanium; 0 to 0.5 weight percent zirconium; 0 to 0.5 weight percent vanadium; 50 to 1000 ppm strontium; 10 to 100 ppm phosphorus; 0 to 0.1 weight percent trace other elements; and the balance aluminum.

Further additional features may be provided, such as: the aluminum alloy containing about 15 weight percent silicon, about 1.5 weight percent copper, about 0.4 weight percent magnesium, 0 to 0.4 weight percent iron, 0 to 0.5 weight percent manganese, 0.1 to 0.6 weight percent nickel, 0 to 0.5 weight percent zinc, 0.1 to 0.3 weight percent titanium, 0.1 to 0.3 weight percent zirconium, 0.15 to 0.3 weight percent vanadium, 50 to 100 ppm strontium, 10 to 50 ppm phosphorus. In some variations, the silicon may be provided in an amount of 14.5 to 15.5 weight percent, the copper may be provided in an amount of 1.0 to 2.0 weight percent, and the magnesium may be provided in an amount of 0.35 to 0.45 weight percent.

A die cast article, such as a transmission clutch housing, is provided and cast from any of the versions of the aluminum alloy disclosed herein.

BRIEF DESCRIPTION OF THE DRAWINGS

The drawings are provided for illustration purposes only and are not intended to limit this disclosure or the claims appended hereto.

DETAILED DESCRIPTION

Figure 1:
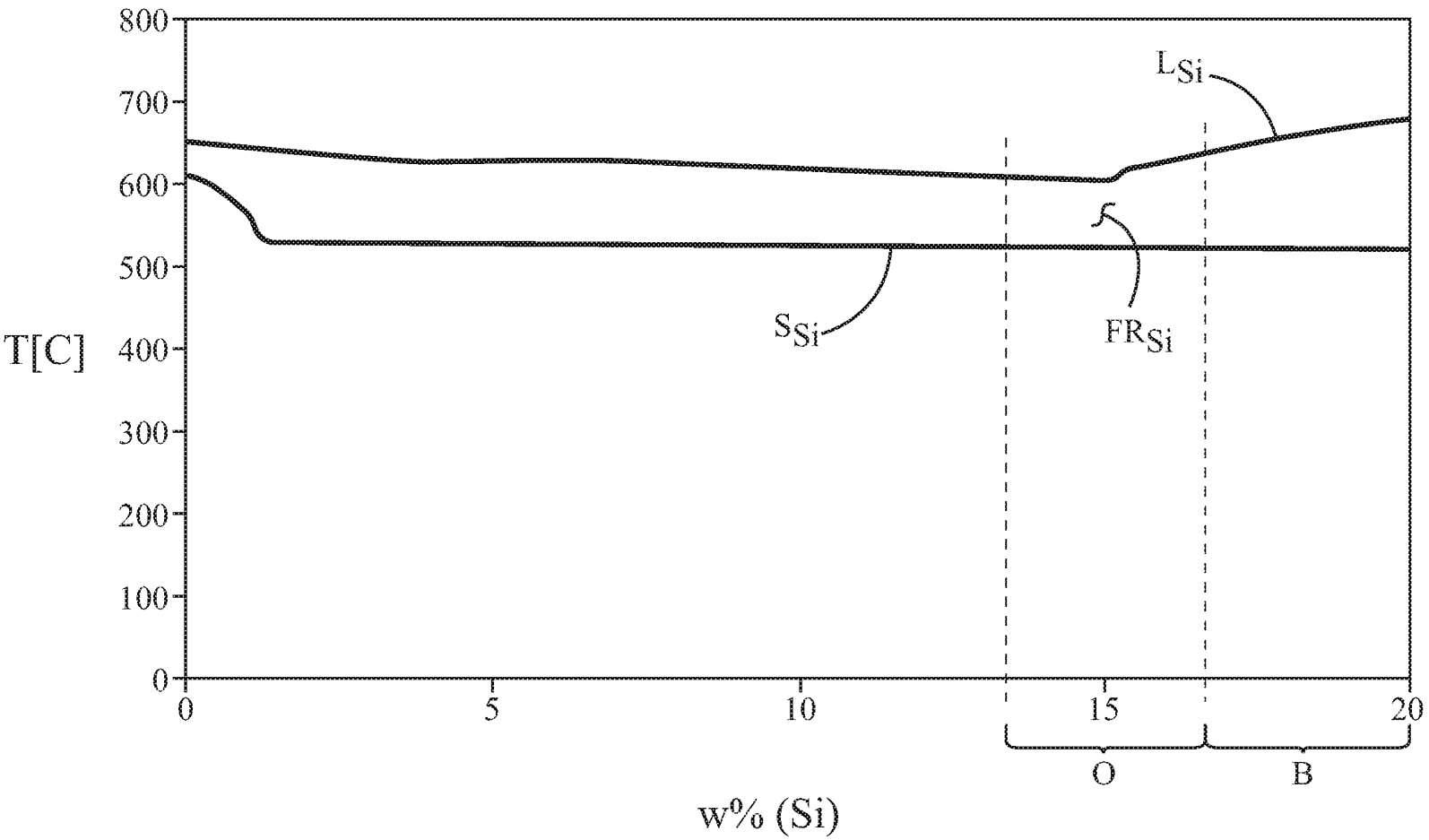
FIG. 1 is a graph showing a portion of a calculated phase diagram of a version of the alloy showing phase transformations as a function of silicon (Si) content.

High strength and high wear-resistant aluminum alloys are provided. In comparison to other aluminum alloys, these alloys exhibit improved material strength, wear resistance, and a desirable amount of ductility and castability. As such, these alloys have reduced porosity and brittleness. As a result, the scrap rate for aluminum casting and the manufacturing cost can be reduced. In some examples, alloy high temperature properties and engine performance can be improved.

The alloy may contain a moderate-to-high amount of silicon to promote wear resistance, with a low amount of copper and zinc to reduce porosity. Some magnesium and zinc is included to allow for improved properties through natural hardening. Strontium may be included to modify the silicon morphology, especially eutectic silicon morphology to improve alloy ductility. A small amount of phosphorus may be included to promote primary silicon nucleation so that the first phase to solidify is silicon, and increase the number of small silicon particles.

The aluminum alloy may include by weight about 13.0 to about 17.0 weight percent (wt %) silicon (Si), about 0.3 to about 0.6 wt % magnesium (Mg), and at least 75 wt % aluminum.

The aluminum may also include copper (Cu) in an amount up to about 2.0 wt % (or 0 to 2.0 wt % copper), iron (Fe) in amount up to about 0.5 wt % (or 0 to 0.5 wt % iron), manganese (Mn) in an amount up to about 1.0 wt % (or 0 to 1.0 wt % manganese), nickel (Ni) in an amount up to about 1.0 wt % (or 0 to 1.0 wt % nickel), zinc (Zn) in an amount up to about 0.8 wt % (or 0 to 0.8 wt % zinc), titanium (Ti) in an amount up to about 0.5 wt % (or 0 to 0.5 wt % titanium), zirconium (Zr) in an amount up to about 0.5 wt % (or 0 to 0.5 wt % zirconium); vanadium (V) in an amount up to about 0.5 wt % (or 0 to 0.5 wt % vanadium); other trace elements in an amount up to about 0.1 wt % (or 0 to 0.1 wt % other trace elements). The aluminum alloy may also include about 50 to about 1000 ppm strontium (Sr) (or 50 to 1000 ppm strontium) and about 10 to about 100 ppm phosphorus (P) (or 10 to 100 ppm phosphorus).

Preferably, the alloy composition may contain about 15 wt % silicon, about 1.5 wt % copper, about 0.4 wt % magnesium, about 0.4 wt % max iron (or 0 to 0.4 wt % iron), about 0.5 wt % max manganese (or 0 to 0.5 wt % manganese), about 0.6 wt % max nickel (or 0 to 0.6 wt % nickel), about 0.5 wt % max zinc (or 0 to 0.5 wt % zinc), about 0.3 wt % max titanium (or 0 to 0.3 wt % titanium), about 0.3 wt % max zirconium (or 0 to 0.3 wt % zirconium), about 0.3 wt % max vanadium (or 0 to 0.3 wt % vanadium), about 0.1 wt % max (or 0 to 0.1 wt %) each of other trace elements, about 50 to about 100 ppm strontium, about 10 to about 50 ppm phosphorus, and the balance aluminum (Al).

In some versions, each of the titanium and zirconium are provided in an amount of about 0.1 to about 0.3 wt % each, the vanadium is provided in amount of about 0.15 to about 0.3 wt %, and the nickel is provided in amount of about 0.1 to about 0.6 wt %. The iron and manganese are preferably provided in roughly equal ratios; for example, the iron and the manganese may be provided in amounts that are no more than 25% different from each other, or with ratios of no more than 1:1.25 with respect to each other.

Four examples of composition ranges of the new alloy (called Version 1, Version 2, Version 3, and Version 4 in these examples) are listed in Table 1. However, any combination of the ranges shown from each version could be used interchangeably with another version.

TABLE 1

Chemical compositions of four versions of the new alloy.

| Alloy | Si | Cu | Mg | Fe | Mn | Ni | Zn | Ti | Zr | V | Sr | P | Others |
|---|---|---|---|---|---|---|---|---|---|---|---|---|---|
| Version 1 | 13.0-17.0 | 0-2.0 | 0.3-0.6 | <0.8 | <1.0 | <1.0 | <0.8 | <0.5 | <0.5 | <0.5 | 50-1000 ppm | 10-100 ppm | <0.1 in total |
| Version 2 | 15 | 1.5 | 0.4 | <0.4 | <0.5 | <0.6 | <0.5 | <0.3 | <0.3 | <0.3 | 50-100 ppm | 10-50 ppm | <0.1 in total |

TABLE 1-continued

Chemical compositions of four versions of the new alloy.

| Alloy | Si | Cu | Mg | Fe | Mn | Ni | Zn | Ti | Zr | V | Sr | P | Others |
|---|---|---|---|---|---|---|---|---|---|---|---|---|---|
| Version 3 | 13-15.9 | 0.5-2.0 | 0.3-0.5 | <0.4 | <0.5 | <0.6 | <0.5 | <0.3 | <0.3 | <0.3 | 50-100 ppm | 10-50 ppm | <0.1 in total |
| Version 4 | 13-17 | 1.0-2.0 | 0.35-0.45 | <0.4 | <0.5 | <0.6 | <0.5 | <0.3 | <0.3 | <0.3 | 50-100 ppm | 10-50 ppm | <0.1 in total |

Optimized Si Content in the New Aluminum Alloys in Comparison with Traditional 390 & its Variants.

Though silicon is generally known to increase wear resistance in aluminum alloys, if too much silicon is provided, a higher (undesirable) freezing range is present. Reducing the freezing range $FR_{Si}$ reduced the shrinkage porosity. For example, FIG. 1 shows a graph of a calculated phase diagram of a version of the new alloy showing phase transformations as a function of silicon (Si) content. Temperature in degrees Celsius is shown on the vertical axis, and silicon in wt % is shown in the horizontal axis. The freezing range is shown at $FR_{Si}$ between the liquidus line Ls, and the solidus line $S_{Si}$. For an aluminum alloy containing about 1.5 wt % copper, about 0.4 wt % magnesium, about 0.4 wt % iron, about 0.5 wt % manganese, about 0.6 wt % nickel, and about 0.5 wt % zinc, it was found that the freezing range $FR_{Si}$ was minimized with a content of silicon between about 13.0 and about 17.0 wt % percent (optimized range O). Thus, the new alloy includes an amount of silicon in the optimized range O. Typical 390 alloys contain an amount of silicon over the optimized range O, in a brittle range B.

Reduced Cu Content in the New Aluminum Alloys in Comparison with Traditional 390 & its Variants.

Though copper is generally known to increase strength and hardness in aluminum alloys, on the downside, copper generally reduces the corrosion resistance of aluminum; and, in certain alloys and tempers, copper increases stress corrosion susceptibility. Copper also increases the alloy freezing range and decreases feeding capability, leading to a high potential for shrinkage porosity. Furthermore, copper is expensive and heavy.

Figure 2:
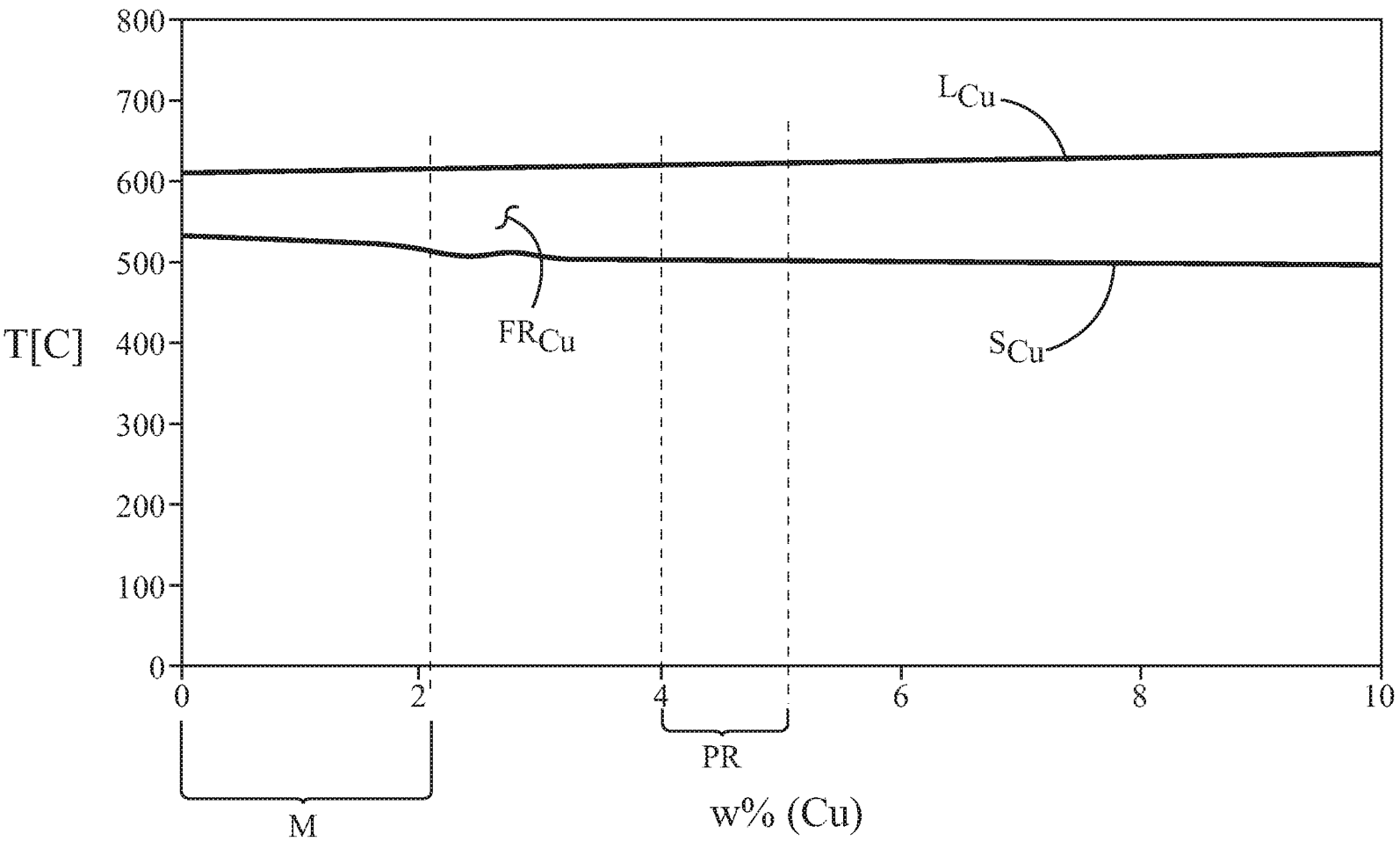
FIG. 2 is a graph showing a portion of a calculated phase diagram of a version of the alloy showing phase transformations as a function of copper (Cu) content.

Reducing the freezing range $FR_{Cu}$ reduced the shrinkage porosity formation. FIG. 2 shows a graph of a calculated phase diagram of a version of the new alloy showing phase transformations as a function of copper (Cu) content. Temperature in degrees Celsius is shown on the vertical axis, and copper in wt % is shown in the horizontal axis. The freezing range is shown at $FR_{Cu}$ between the liquidus line $L_{Cu}$ and the solidus line $S_{Cu}$. For an aluminum alloy containing about 15 wt % silicon, about 0.4 wt % magnesium, about 0.4 wt % iron, about 0.5 wt % manganese, about 0.6 wt % nickel, and about 0.5 wt % zinc, it was found that the freezing range $FR_{Cu}$ was minimized when copper was minimized (minimized range M). Thus, the new alloy includes an amount of copper in the minimized range M, where copper in wt % is shown in the horizontal axis. Typical 390 alloys contain an amount of copper over the optimal minimized range M, in a porous range PR. This is because copper is helpful or for heat treating the cast aluminum alloy, but if the cast aluminum alloy is not heat treated, then the copper can be left out or minimized to decrease porosity.

Decreased Mg in the New Aluminum Alloys in Comparison with Traditional 390 & its Variants.

Like copper, magnesium improves properties when heat treating an aluminum alloy, but magnesium allows improves properties when cooling/hardening at room temperature, as well. Accordingly, magnesium is useful in an aluminum alloy. However, magnesium also increases the alloy freezing range.

Figure 3:
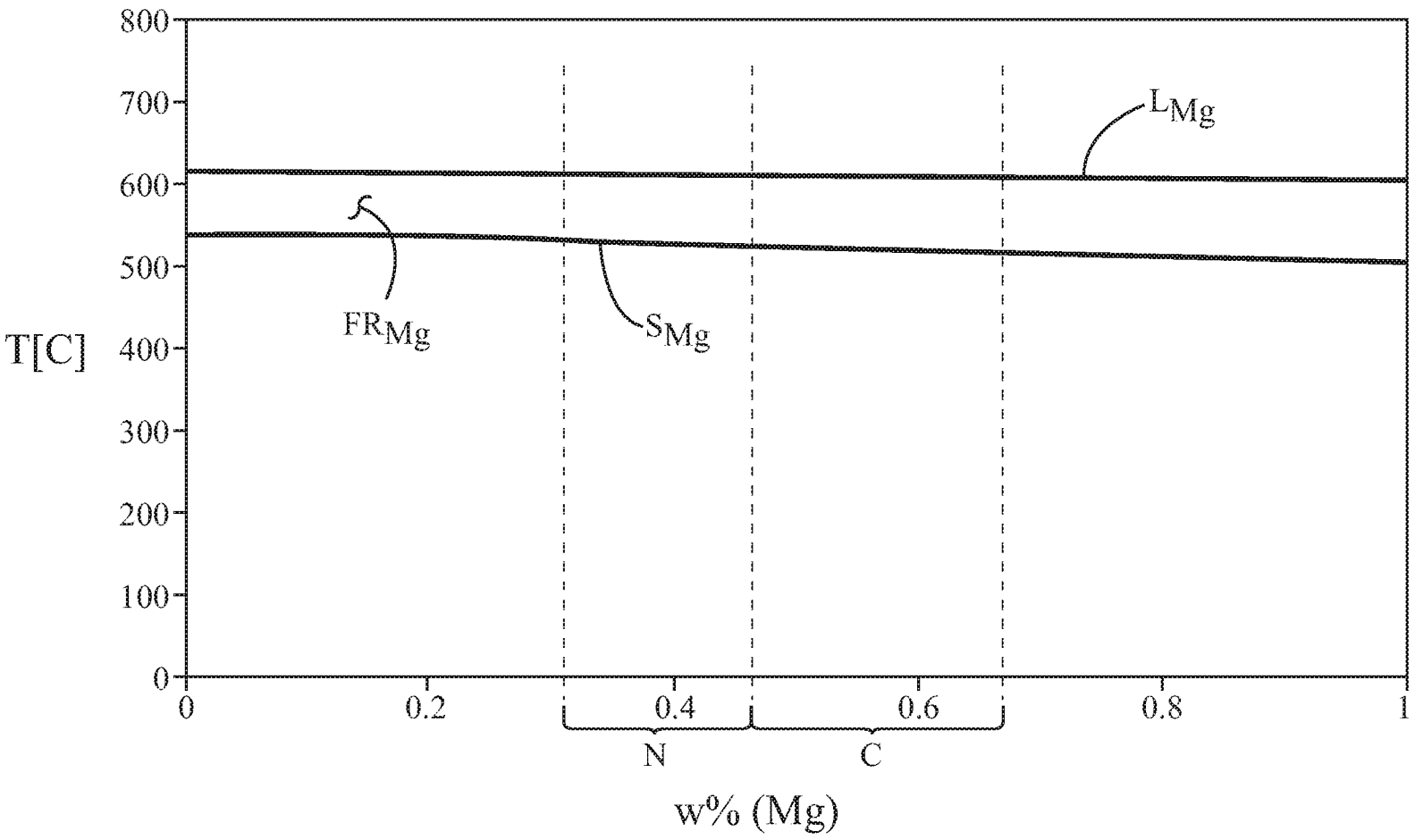
FIG. 3 is a graph showing a portion of a calculated phase diagram of a version of the alloy showing phase transformations as a function of magnesium (Mg) content.

FIG. 3 shows a graph of a calculated phase diagram of a version of the new alloy showing phase transformations as a function of magnesium (Mg) content. Temperature in degrees Celsius is shown on the vertical axis, and magnesium in wt % is shown in the horizontal axis. The freezing range is shown at $FR_{Mg}$ between the liquidus line $L_{Mg}$ and the solidus line $S_{Mg}$. Reducing the freezing range $FR_{Mg}$ reduced the shrinkage porosity formation. For example, for an aluminum alloy containing about 15 wt % silicon, about 1.5 wt % copper, about 0.4 wt % iron, about 0.5 wt % manganese, about 0.6 wt % nickel, and about 0.5 wt % zinc, it was found that the freezing range $FR_{Mg}$ was minimized when magnesium was minimized. However, magnesium aids with natural hardening, so an optimized range for magnesium content was identified at region N, to minimize the freezing range $FR_{Mg}$ while keeping some magnesium for its benefits in the hardening process. Thus, the new alloy includes an amount of magnesium in the optimized range N. Typical 390 alloys contain an amount of magnesium over the optimized range N, in a brittle range C. This is because magnesium is helpful or for heat treating the cast aluminum alloy, but if the cast aluminum alloy is not heat treated, then the magnesium can be decreased to decrease porosity.

Optimized Other Alloying Elements in the New Alloy

Compared with a traditional 390 alloy, the new alloys have a slightly lower content of Si and other elements that hurt ductility, such as Fe, Cu, and Zn. Sr and P are used to control morphology of both primary and eutectic Si particles to improve ductility. To maintain alloy die soldering resistance, manganese and iron may be provided in similar amounts. For example, iron and manganese are provided in amounts that are no more than 25% different from each other; in other words, their ratios may be provided as no more than 1:1.25 with respect to each. It should be noted that the ratio of Fe/Mn is optimized in the new alloy to eliminate the formation of β-Fe (Al5FeSi). To further improve alloy performance at elevated temperatures, the alloy may contain Cr, Ti, Zr, and/or V.

Demonstration

In one example, the new alloy may contain aluminum and about 15 wt % Si, about 1.5 wt % copper, about 0.4 wt % Mg, about 0.6 wt % Ni, about 0.5 wt % Zn, about 0.4 wt % Fe, about 0.5 wt % Mn, about 0.3 wt % Zr, about 0.3 wt % Ti, and about 0.3 wt % V (Version 5). Table 2 shows the mechanical properties of the new alloy with the make-up of this Version 5, compared with a traditional B390 aluminum alloy. As can be seen, the new alloy (Version 5) has a higher yield strength (YS), a higher ultimate tensile strength (UTS), and an improved elongation (El) percentage.

TABLE 2

Mechanical properties of the new alloy (Version 5).

| | YS (MPa) | UTS (MPa) | El (%) |
|---|---|---|---|
| Version 4 | 221 | 303 | 1.5 |
| B390 | 177 | 212 | 0.2 |

The alloys herein may be produced by melting and alloying the elements of the alloy, except for the morphology improving elements (e.g., Sr and P). Next, the molten alloy may be degassed. Then, the Sr and/or P may be added. The alloy may then be cast to produce an article and hardened naturally or artificially, by way of example.

Figure 4:
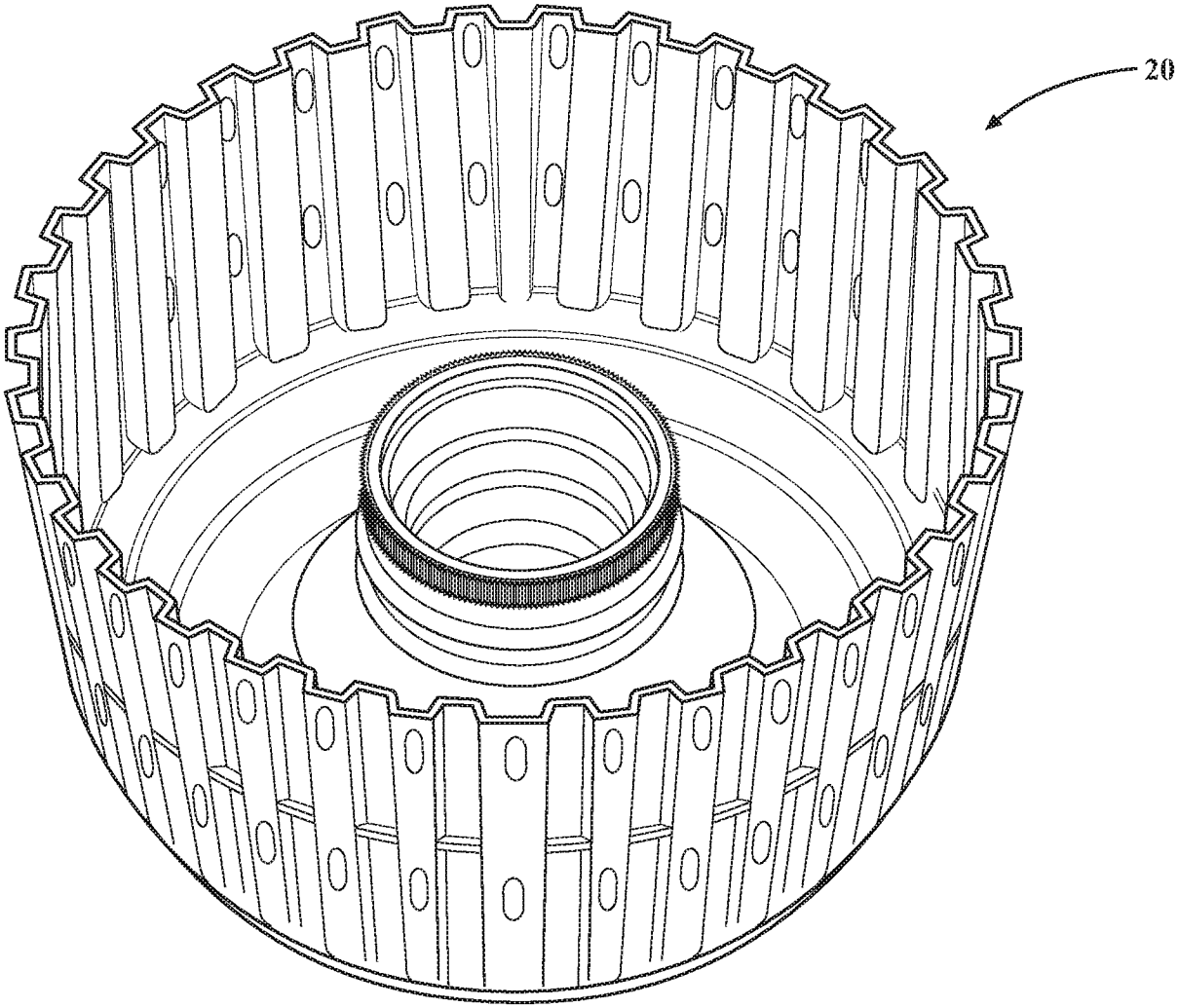
FIG. 4 is a perspective view of a transmission clutch housing formed of an aluminum alloy, in accordance with the principles of the present disclosure.

The alloys described herein may be used to manufacture a cast article, such as a transmission clutch housing. Therefore, it is within the contemplation of the inventors herein that the disclosure extends to cast articles, including transmission clutch housings, pistons, and engine blocks, by way of example, containing the improved alloy (including examples, versions, and variations thereof). For example, referring to FIG. 4, a transmission clutch housing 20 is illustrated, which is made of any variation of the aluminum alloy described herein.

Furthermore, while the above examples are described individually, it will be understood by one of skill in the art having the benefit of this disclosure that amounts of elements described herein may be mixed and matched from the various examples within the scope of the appended claims.

It is further understood that any of the above described concepts can be used alone or in combination with any or all of the other above described concepts. Although an embodiment of this invention has been disclosed, a worker of ordinary skill in this art would recognize that certain modifications would come within the scope of this invention. For that reason, the following claims should be studied to determine the true scope and content of this invention.

What is claimed is:

1. An aluminum alloy suitable for die casting, the aluminum alloy consisting essentially of:

14.5 to 15.5 weight percent silicon;
1.0 to 2.0 weight percent copper;
0.35 to 0.45 weight percent magnesium;
0 to 0.4 weight percent iron;
0 to 0.5 weight percent manganese;
0.1 to 0.6 weight percent nickel;
0 to 0.5 weight percent zinc;
0.1 to 0.3 weight percent titanium;
0.1 to 0.3 weight percent zirconium;
0.15 to 0.3 weight percent vanadium;
50 to 100 ppm strontium; and
10 to 50 ppm phosphorus;
0 to 0.1 weight percent trace other elements; and
the balance aluminum.

2. The aluminum alloy of claim 1, wherein the iron and manganese are provided in amounts that are no more than 25% different from each other.

3. A die cast article, cast from an aluminum alloy according to claim 1.

4. A die cast transmission clutch housing, cast from an aluminum alloy according to claim 1.

* * * * *